US007785077B2

(12) United States Patent
Richardson et al.

(10) Patent No.: US 7,785,077 B2
(45) Date of Patent: Aug. 31, 2010

(54) CEILING FAN HANGING SYSTEM

(75) Inventors: Anthony Todd Richardson, Medina, TN (US); Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 668 days.

(21) Appl. No.: 11/749,453

(22) Filed: May 16, 2007

(65) Prior Publication Data

US 2008/0286111 A1 Nov. 20, 2008

(51) Int. Cl.
*F04D 29/64* (2006.01)

(52) U.S. Cl. ..... 416/244 R; 417/423.15

(58) Field of Classification Search ..... 416/244 R; 403/378; 411/399, 366.1, 398, 371.2
See application file for complete search history.

(56) References Cited

U.S. PATENT DOCUMENTS

| | | | | | |
|---|---|---|---|---|---|
| 350,231 | A | * | 10/1886 | Brown | 411/399 |
| 1,496,460 | A | | 6/1924 | Hofrichter | |
| 2,857,095 | A | | 10/1958 | Grau | |
| 4,448,388 | A | | 5/1984 | Dennis et al. | |
| 4,538,973 | A | | 9/1985 | Angott et al. | |
| 4,729,725 | A | * | 3/1988 | Markwardt | 416/244 R |
| 4,871,327 | A | * | 10/1989 | Ridgway et al. | 439/543 |
| 4,878,806 | A | | 11/1989 | Markwardt | |
| 5,222,864 | A | | 6/1993 | Pearce | |
| 5,507,619 | A | | 4/1996 | Ryan | |
| D414,256 | S | | 9/1999 | Thomas, Jr. | |
| 5,988,580 | A | | 11/1999 | Bucher et al. | |
| 6,036,154 | A | | 3/2000 | Pearce | |
| 6,139,279 | A | | 10/2000 | Pearce et al. | |
| 6,171,061 | B1 | | 1/2001 | Hsu | |
| 6,234,757 | B1 | | 5/2001 | Pearce | |
| 6,311,943 | B1 | * | 11/2001 | Tang | 416/244 R |
| 6,872,054 | B2 | | 6/2004 | Pearce | |
| 6,932,578 | B2 | | 8/2005 | Pearce | |

FOREIGN PATENT DOCUMENTS

JP 62271993 A 11/1987

(Continued)

OTHER PUBLICATIONS

Japanese Patent Office Machine Translation of JP 2008121551A. Accessed Jan. 15, 2010.*

*Primary Examiner*—Richard Edgar
(74) *Attorney, Agent, or Firm*—Baker Donelson

(57) ABSTRACT

A ceiling fan hanging system (10) in disclosed for use with a conventional ceiling fan (11). The hanging system includes a downrod (15) and a downrod receiver (16). The downrod has a lower end (20) having a select outside diameter and a pair of mutually aligned holes (21) therethrough. The downrod receiver has a tubular neck portion (22) having an internal channel (23) with an internal diameter configured to receive the lower end of the downrod. The neck portion has an oblong first mounting hole (24) and a generally round second mounting hole (25). The downrod receiver also includes a mounting bolt (26) and a mounting nut (27) configured to be threadably received upon mounting bolt. Mounting bolt has an oblong head (29) configured to be nestably received within oblong first mounting hole and a shank (31) extending from head. The oblong head includes an inboard or inwardly facing surface (32) which is curved to conform with and fit snugly against the exterior of the downrod.

10 Claims, 3 Drawing Sheets

FOREIGN PATENT DOCUMENTS

| | | | | |
|---|---|---|---|---|
| JP | 01142296 | A | | 6/1989 |
| JP | 06088596 | A | | 3/1994 |
| JP | 2008121551 | A | * | 5/2008 |
| WO | WO 2008/059665 | A1 | * | 5/2008 |

* cited by examiner

CEILING FAN HANGING SYSTEM

TECHNICAL FIELD

This invention relates to ceiling fans and specifically to a system for quickly mounting and connecting the motor of a ceiling fan to a downrod.

BACKGROUND OF THE INVENTION

Traditionally, ceiling fans have been installed by a laborious, time consuming and often cumbersome practice. The conventional ceiling fan includes a ceiling plate which is secured to an electric outlet box by passing the lead wires of the outlet box through a central circular opening in the ceiling plate. Mounting screws are passed through two elongated openings in the ceiling plate to threadably engage with two threaded holes diagonally separated from each other on the periphery of the outlet box. Alternatively, wood screws are passed through the ceiling plate and the outlet box and into a wood stud which supports the outlet box. In either event, the screws are tightened until the ceiling plate is securely mounted on the outlet box. The typical ceiling plate includes a hanging hook.

When a typical ceiling fan assembly is mounted to the ceiling plate, the motor, fan blades and an optional light assembly are secured to a canopy by a down rod or hanger rod. The down rod passes through a central opening in the canopy with a ball mount located at an upper end of the down rod engaged by a periphery of the opening of the canopy, or alternatively a hanger bracket.

The opposite end or lower end of the downrod has external threads so that it may be threaded into an internally threaded receiver mounted to the top end of the motor. Alternatively, the internally threaded receiver may be mounted to a motor housing surrounding the motor or a combination of the motor and motor housing. The receiver and downrod lower end may also include a set of holes through which a set pin may be passed to prevent the unwanted rotation of the downrod relative to the receiver. However, it is oftentimes difficult to rotationally align the downrod holes with the receiver holes in order to pass the set pin through each while still maintaining a tightened position of the downrod within the receiver. Alternatively, the receiver may include a set screw which simply bears upon the downrod to prevent relative rotation.

Accordingly, it is seen that a need has long existed for a ceiling light mounting system that could be more easily and quickly mounted a ceiling fan. It thus is to the provision of such that the present invention is primarily directed.

SUMMARY OF THE PRESENT INVENTION

In a preferred form of the invention, a ceiling fan comprises a downrod having a lower end with a pair of mutually aligned mounting holes therethrough, and a downrod receiver having an internal channel configured to receive at least a portion of the downrod lower end, a non-circular first mounting hole and a second mounting hole aligned with the first mounting hole, and a mounting bolt having a non-circular head configured to be nested within the non-circular first mounting hole.

DETAILED DESCRIPTION

Figure 1:
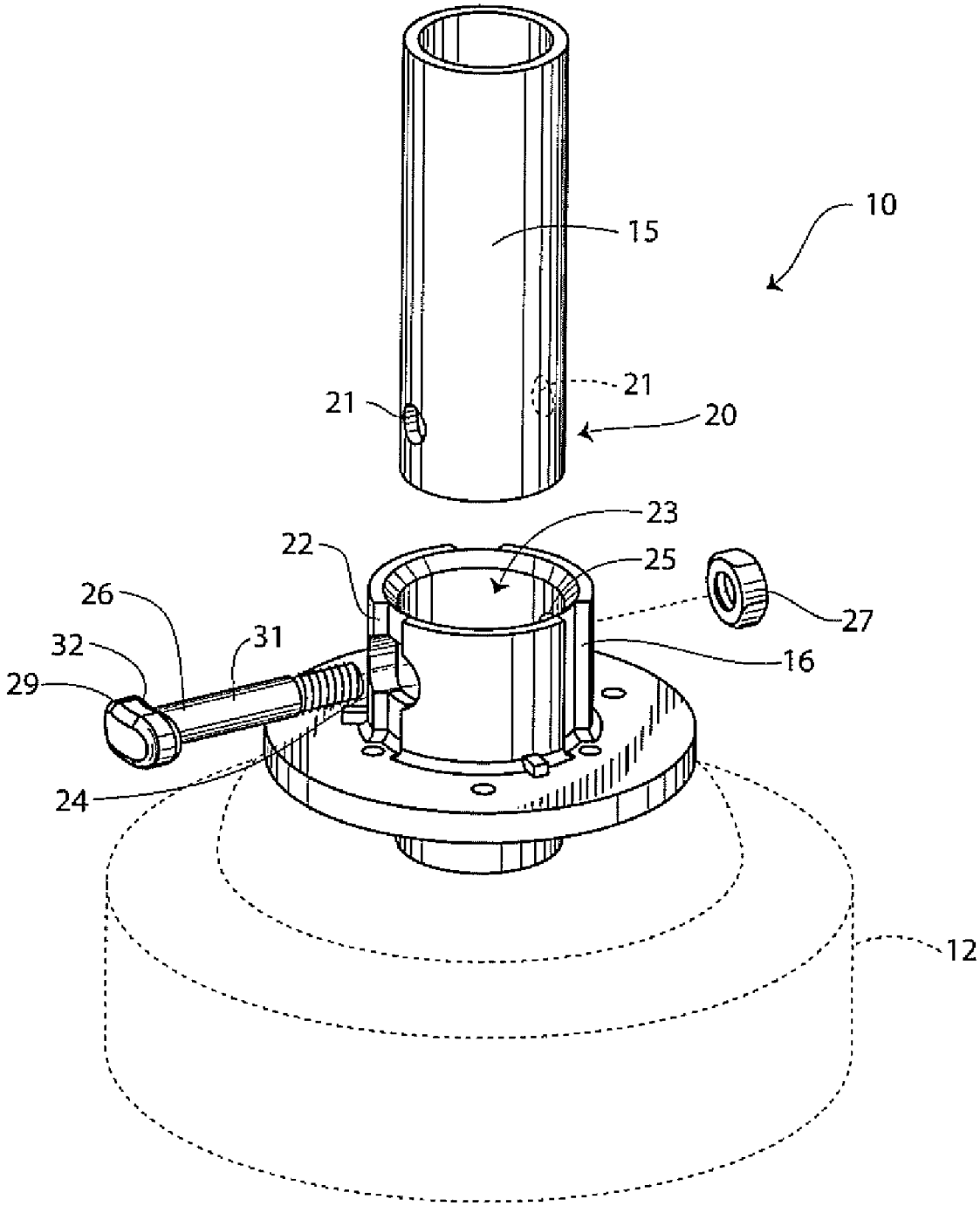
FIG. 1 is a perspective view of a portion of a ceiling fan mounting system in a preferred form of the invention.
Figure 2:
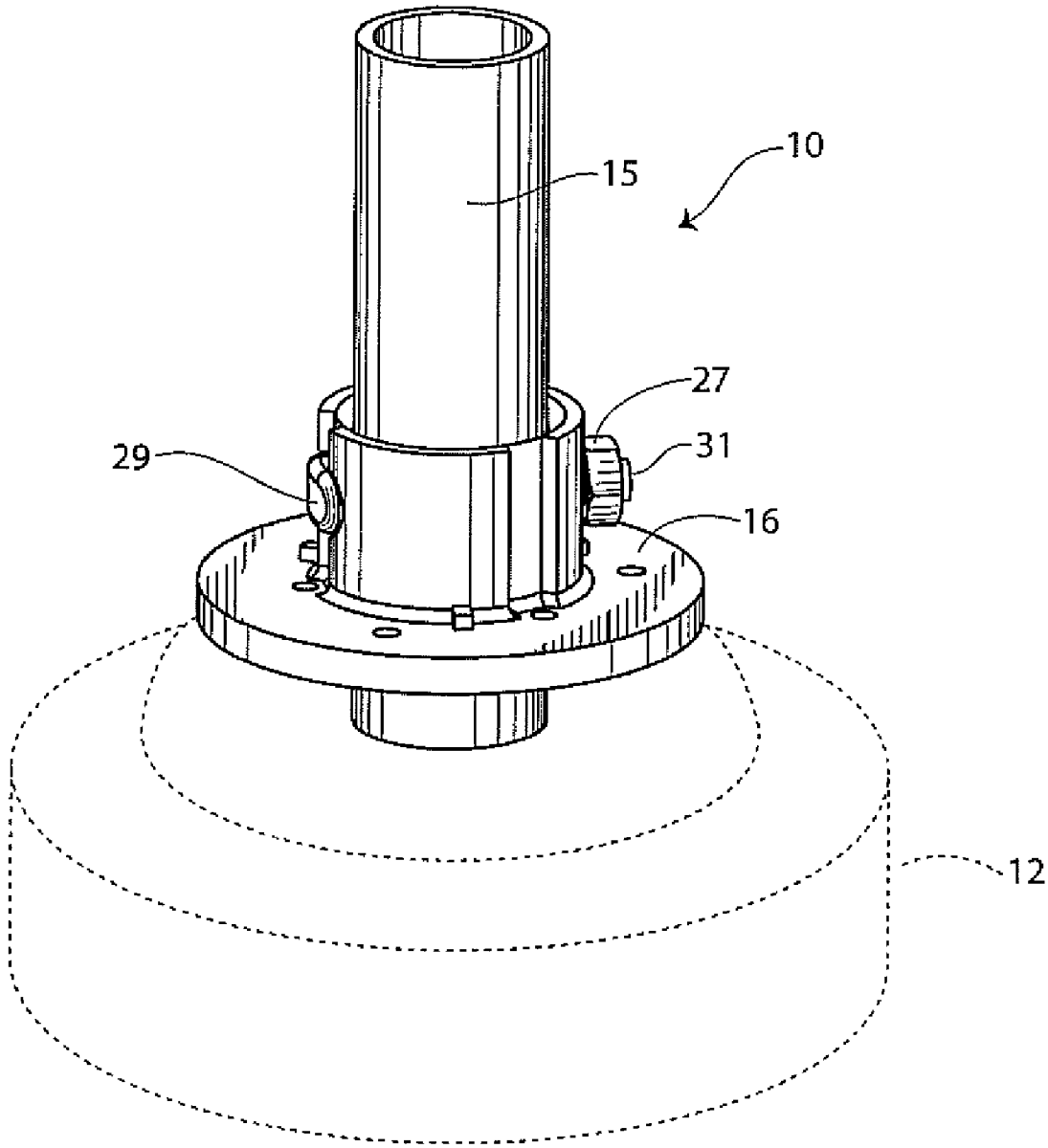
FIG. 2 is a perspective view of the ceiling fan mounting system of FIG. 1.
Figure 3:
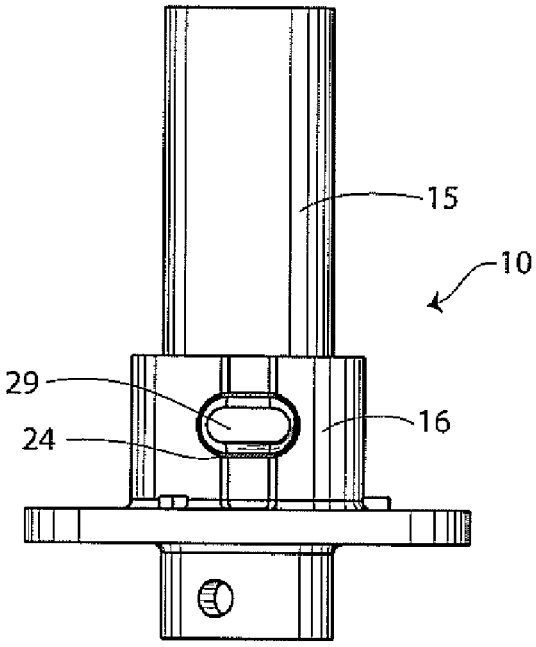
FIG. 3 is a front view of the ceiling fan mounting system of FIG. 1.
Figure 4:
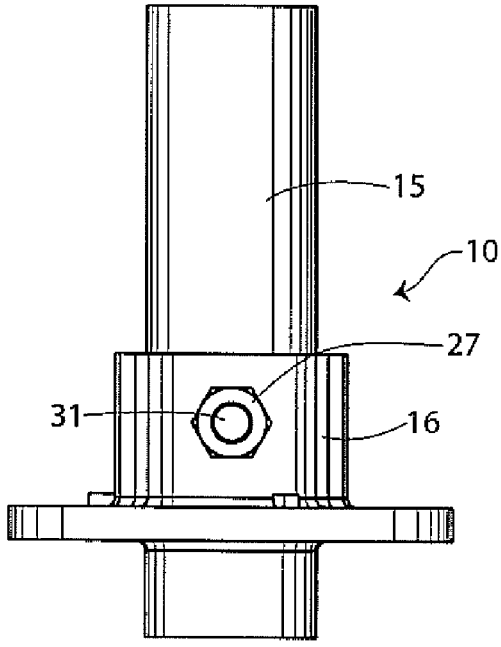
FIG. 4 is a rear view of the ceiling fan mounting system of FIG. 1.

With reference next to the drawings, there is shown a ceiling fan hanging system 10 in a preferred form of the invention which is adapted to be utilized with a conventional ceiling fan. The ceiling fan includes a fan motor 12 shown in phantom lines in FIG. 1. The hanging system includes a downrod 15 and a downrod receiver 16. The downrod receiver is typically mounted to the top end of the fan motor 12, the top end of a fan motor housing or a combination of the motor and motor housing. The top end of the downrod is coupled to a conventional mounting bracket or canopy system.

The downrod 15 has a lower end 20 having a select outside diameter and a pair of mutually aligned holes 21 therethrough.

The downrod receiver 16 has a tubular neck portion 22 having an internal channel 23 with an internal diameter configured to receive the lower end 20 of the downrod. The neck portion 22 has an oblong first mounting hole 24 and a generally round second mounting hole 25 oppositely disposed from first mounting hole 24. The downrod receiver 16 also includes a mounting bolt 26 and a mounting nut 27 configured to be threadably received upon mounting bolt 26. Mounting bolt 26 has an oblong head 29 configured to be nestably received within oblong first mounting hole 24 and a shank 31 extending from head 29. The oblong head 29 includes an inboard or inwardly facing surface 32 which is curved to conform with and fit snugly against the exterior of the downrod. The end portion of the shank is externally threaded to receive mounting nut 27.

In use, the downrod lower end 20 is slid into the internal channel 23 of the receiver neck portion 22. The downrod is then rotated relative to the receiver 16 so that the downrod mounting holes 21 are in alignment with the receiver first and second mounting holes 24 and 25. The mounting bolt 26 is then passed through the receiver first mounting hole 24, downrod mounting holes 21, and the receiver second mounting hole 25. The mounting bolt 26 is moved to a position wherein the oblong head 29 is positioned within the oblong first mounting hole 24, wherein the fit therebetween prevents relative rotational movement of the mounting bolt. Mounting nut 27 is then threaded onto the threaded portion of the shank 31 and tightened. The curvature of the inwardly facing surface 32 of the bolt head 29 allows for a tight fit between the bolt 26 and the downrod 15 and further restricts the rotation of the bolt head during the tightening of the nut.

With this construction, the need for rotationally threading the downrod into the receiver is eliminated, thereby easing the mounting process. Furthermore, the elimination of the threading aspect also negates the necessity of aligning the mounting holes of the receiver and downrod while maintaining a tight threaded fit therebetween.

It should be understood that the oblong first mounting hole and bolt head is not limited to the oblong shape shown in the preferred embodiment. The bolt head and corresponding mounting hole may be of any shape which restricts rotational movement therebetween, including but not limited to polygonal shapes, elongated curved shapes, and the like. As such, the head and hole may be termed to include any non-circular shape, as a circular head and hole would not restrict rotational movement therebetween.

It thus is seen that a ceiling fan hanging system is now provided that overcomes problems associated with the prior art. It should be understood that many modifications may be made to the specific preferred embodiment described herein without departure from the spirit and scope of the invention as described by the following claims.

The invention claimed is:

1. A ceiling fan hanging system comprising:

a downrod having a lower end with a pair of mutually aligned mounting holes therethrough, and a downrod receiver having a tubular neck portion defining an internal channel configured to receive at least a portion of said downrod lower end, a non-circular first mounting hole having a non-circular configuration extending completely through said tubular neck portion and a second mounting hole aligned with said first mounting hole, and a mounting bolt having a non-circular head configured to be nested within said non-circular first mounting hole so as to extend through said tubular neck portion and at least partially into said internal channel.

2. The ceiling fan hanging system of claim 1 wherein said mounting bolt head has a curved inboard surface facing said downrod configured to conform with the exterior surface of said downrod.

3. The ceiling fan hanging system of claim 1 further comprising a nut configured to be threadably received upon said mounting bolt opposite said non-circular head.

4. The ceiling fan hanging system of claim 1 wherein said non-circular head is oblong, and wherein said non-circular first mounting hole is oblong.

5. The ceiling fan hanging system of claim 4 wherein said mounting bolt head has a curved inboard surface facing said downrod configured to conform with the exterior surface of said downrod.

6. A ceiling fan hanging system comprising:

a downrod having first and second mounting holes extending therethrough;

a downrod receiver having a tubular neck portion configured to receive a portion of said downrod including said first and second mounting holes, said downrod receiver tubular neck portion having a non-circular first mounting hole having a non-circular configuration extending completely through said tubular neck portion and a second mounting hole;

said downrod first mounting hole, said downrod second mounting hole, said downrod receiver first mounting hole and said downrod receiver second mounting hole being capable of being mutually aligned, and a mounting bolt having a head portion configured to be received within said downrod receiver tubular neck portion first mounting hole so as to extend through said tubular neck portion and at least partially into contact with said downrod and shaped to restrict rotational movement of said mounting bolt when said head portion is received within said downrod receiver tubular neck portion first mounting hole.

7. The ceiling fan hanging system of claim 6 wherein said mounting bolt head has a curved inboard surface facing said downrod configured to conform with the exterior surface of said downrod.

8. The ceiling fan having system of claim 6 further comprising a nut configured to be threadably received upon said mounting bolt opposite said head portion.

9. The ceiling fan hanging system of claim 6 wherein said head portion is oblong, and wherein said first mounting hole is oblong.

10. The ceiling fan hanging system of claim 9 wherein said mounting bolt head portion has a curved inboard surface facing said downrod configured to conform with the exterior surface of said downrod.

* * * * *